US007799284B2

(12) United States Patent
Ohashi et al.

(10) Patent No.: US 7,799,284 B2
(45) Date of Patent: Sep. 21, 2010

(54) SAMPLE CONTAINER

(75) Inventors: Naoki Ohashi, Tokyo (JP); Tetsuya Abe, Shizuoka (JP)

(73) Assignee: Beckman Coulter, Inc., Brea, CA (US)

( * ) Notice: Subject to any disclaimer, the term of this patent is extended or adjusted under 35 U.S.C. 154(b) by 149 days.

(21) Appl. No.: 12/025,469

(22) Filed: Feb. 4, 2008

(65) Prior Publication Data

US 2009/0022631 A1 Jan. 22, 2009

Related U.S. Application Data

(63) Continuation of application No. PCT/JP2006/315322, filed on Aug. 2, 2006.

(30) Foreign Application Priority Data

Aug. 4, 2005 (JP) ..... 2005-226999

(51) Int. Cl.

| | |
|---|---|
| ***B01L 3/00*** | (2006.01) |
| ***B65D 51/18*** | (2006.01) |
| ***B65D 41/00*** | (2006.01) |
| ***B65D 43/00*** | (2006.01) |
| ***B65D 51/00*** | (2006.01) |
| *B65D 53/00* | (2006.01) |
| *B65D 41/04* | (2006.01) |

(52) U.S. Cl. ..... 422/102; 220/253; 220/254.1; 220/288; 215/235; 215/329; 215/341

(58) Field of Classification Search ..... 422/102; 220/254.1

See application file for complete search history.

(56) References Cited

U.S. PATENT DOCUMENTS

| | | | | |
|---|---|---|---|---|
| 5,202,093 | A | 4/1993 | Cloyd | |
| 5,289,930 | A | 3/1994 | Inouye | |
| 6,265,225 | B1 | 7/2001 | Otto et al. | |
| 2001/0039058 | A1 | 11/2001 | Iheme et al. | |
| 2004/0126278 | A1 | 7/2004 | Takahashi et al. | |
| 2004/0256421 | A1 * | 12/2004 | Werth | 222/480 |
| 2006/0120922 | A1 * | 6/2006 | Matsumoto | 422/64 |

FOREIGN PATENT DOCUMENTS

| | | |
|---|---|---|
| JP | 5-294354 | 11/1993 |
| JP | 06-324052 | 11/1994 |
| JP | 7-500048 | 1/1995 |

(Continued)

*Primary Examiner*—Jill Warden
*Assistant Examiner*—Jennifer Wecker
(74) *Attorney, Agent, or Firm*—Townsend and Townsend and Crew LLP

(57) ABSTRACT

A sample container includes a cap that covers a container body holding a liquid sample containing a reagent and a test body. The cap includes an outer lid that covers the container body, an inner lid that is slidably attached to the outer lid and has an opening for dispensing the liquid sample, a shutter that has a shaft engaging with the inner lid, a translating unit that is fitted to the outer lid and translates sliding movements of the inner lid against the outer lid to rotation of the shutter around the shaft, and a pressing member that presses the shutter in a direction to close the shutter. The rotation of the shutter opens and closes a hole formed in the translating unit for dispensing the liquid sample.

2 Claims, 10 Drawing Sheets

FOREIGN PATENT DOCUMENTS

| | | | | |
|---|---|---|---|---|
| JP | 08-057020 | | | 3/1996 |
| JP | H11-194132 | | | 7/1999 |
| JP | 2002-544076 | | | 12/2002 |
| JP | 2004-157020 | | | 6/2004 |
| JP | 2004-177254 | | | 6/2004 |
| JP | 2005-324832 | | | 11/2005 |
| JP | 2007040898 | A | * | 2/2007 |
| WO | WO 98/31408 | | | 7/1998 |

* cited by examiner

SAMPLE CONTAINER

CROSS-REFERENCE TO RELATED APPLICATIONS

This application is a continuation of PCT international application Ser. No. PCT/JP2006/315322 filed Aug. 2, 2006 which designates the United States, incorporated herein by reference, and which claims the benefit of priority from Japanese Patent Application No. 2005-226999, filed Aug. 4, 2005, and all incorporated herein by reference.

BACKGROUND OF THE INVENTION

1. Field of the Invention

The present invention relates to a sample container which includes a cap that covers a container holding a liquid sample containing a reagent and a test body to suppress evaporation of the liquid sample.

2. Description of the Related Art

Conventionally, a sample container has a cap covering a container to suppress the evaporation of a contained liquid sample containing a reagent and a test body, and one known reagent container has a lid which rotates laterally upward from a cap-sealing position (see, for example, Japanese Patent Application Laid-Open No. H11-194132).

SUMMARY OF THE INVENTION

A sample container according to one aspect of the present invention includes a cap that covers a container body holding a liquid sample containing a reagent and a test body, the cap including an outer lid that covers the container body, an inner lid that is slidably attached to the outer lid and has an opening for dispensing the liquid sample, a shutter that has a shaft engaging with the inner lid, a translating unit that is fitted to the outer lid and translates sliding movements of the inner lid against the outer lid to rotation of the shutter around the shaft, and a pressing member that presses the shutter in a direction to close the shutter, wherein the rotation of the shutter opens and closes a hole formed in the translating unit for dispensing the liquid sample.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
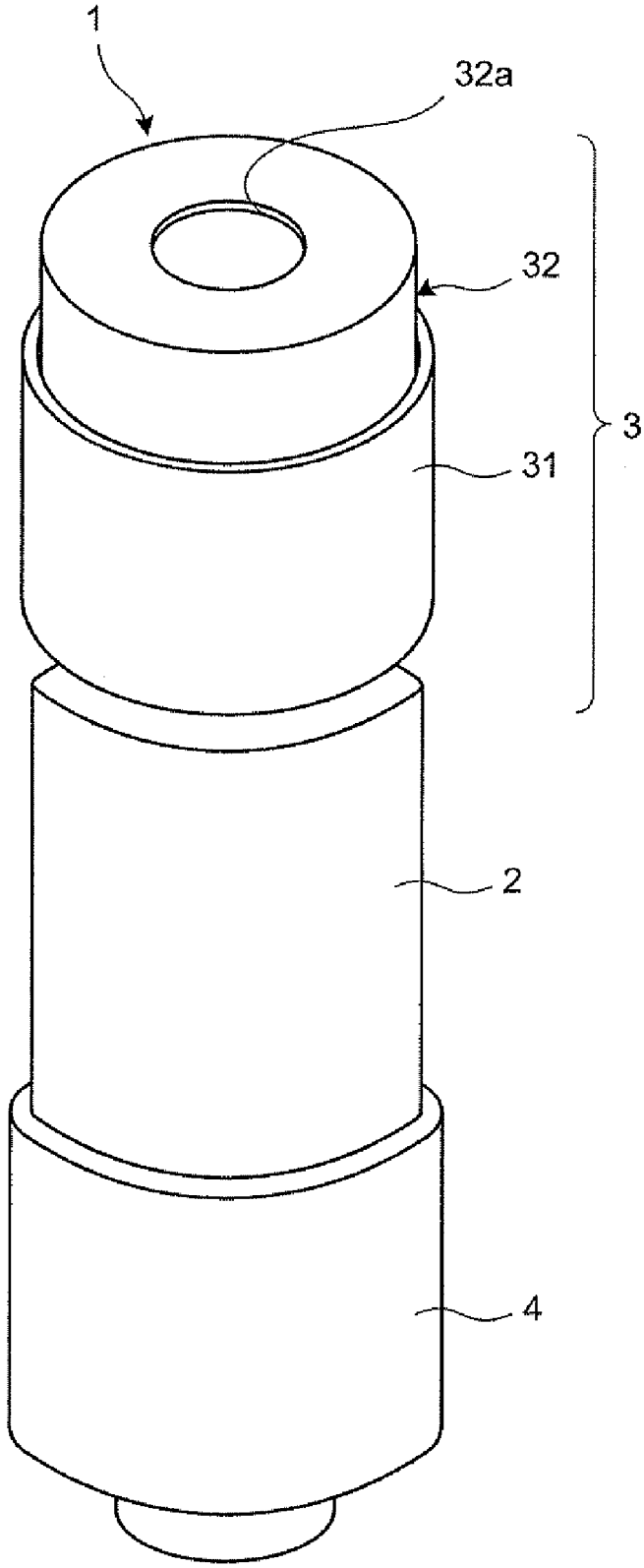
FIG. 1 is a perspective view of a sample container according to the present invention.
Figure 2:
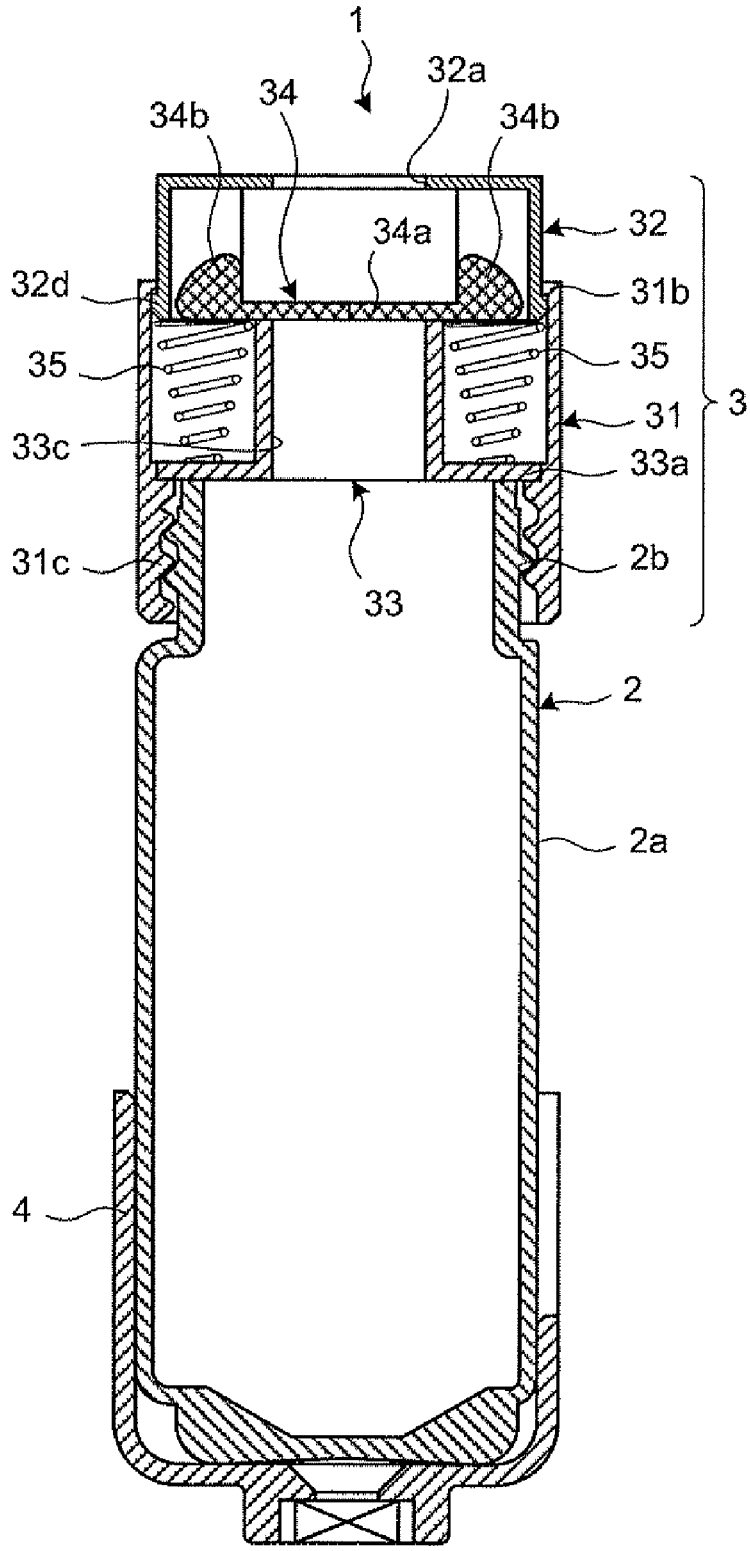
FIG. 2 is a sectional elevation view of the sample container shown in FIG. 1.
Figure 3:
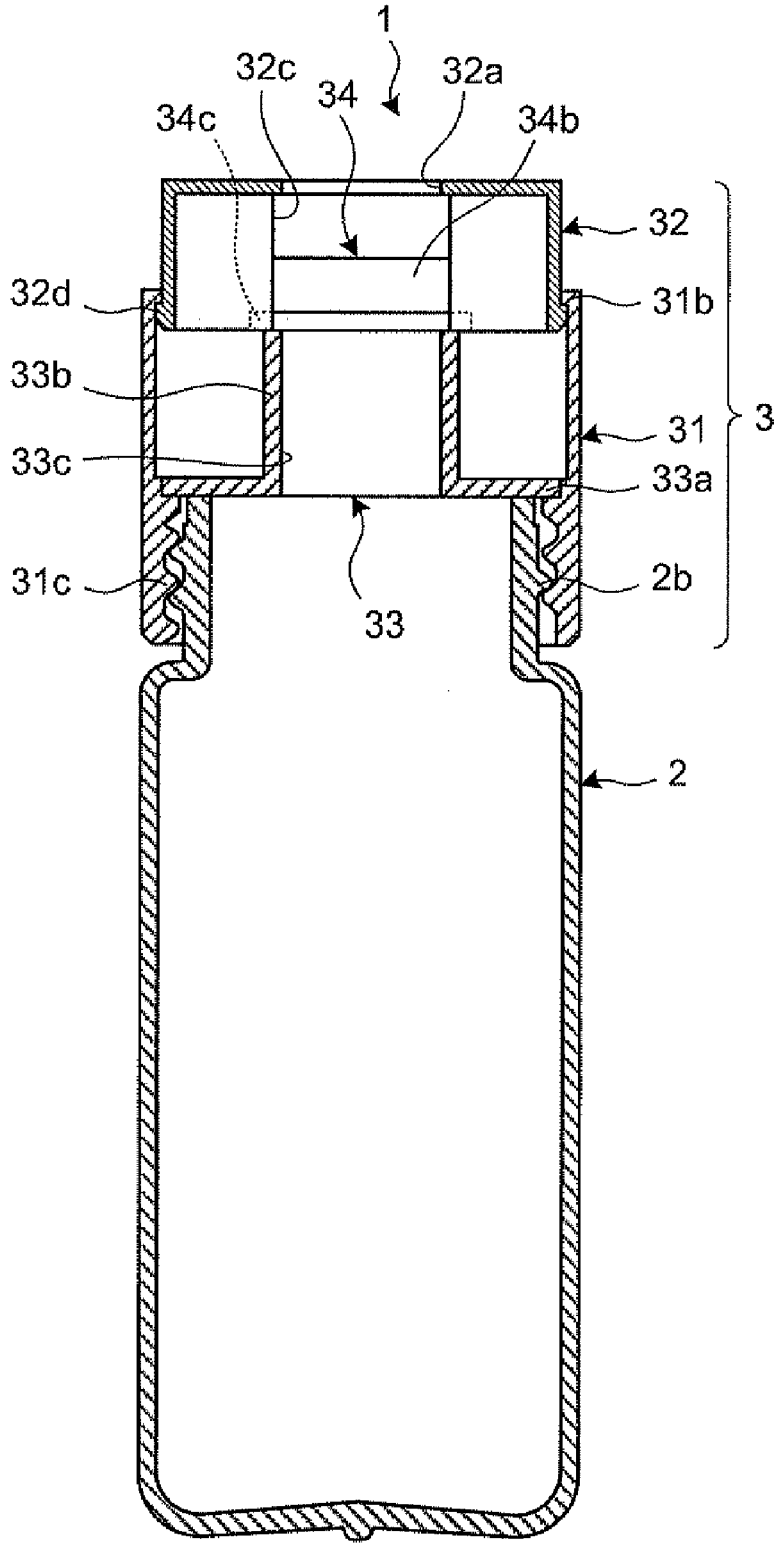
FIG. 3 is a sectional side view of the sample container of FIG. 1 with a cover removed.

Exemplary embodiments of a sample container according to the present invention will be described in detail below with reference to the accompanying drawings. FIG. 1 is a perspective view of the sample container according to the present invention. FIG. 2 is a sectional elevation view of the sample container shown in FIG. 1. FIG. 3 is a sectional side view of the sample container of FIG. 1 with a cover removed.

As shown in FIGS. 1 to 3, a sample container 1 includes a container body 2, a cap 3 covering an upper portion of the container body 2, and a cover 4 attached to a lower portion of the container body 2. As shown in FIG. 2, the container body 2 is substantially cylindrical in shape, and includes a flat portion 2*a* formed on a part of a side surface for label attachment, and a male screw portion 2*b* of a smaller diameter in an upper portion. The cover 4 is cut out in a portion corresponding to the flat portion 2*a* where a label is attached.

The cap 3 includes, as shown in FIGS. 2 and 3, an outer lid 31, an inner lid 32, a translating unit 33, shutters 34, and pressing members 35.

Figure 4:
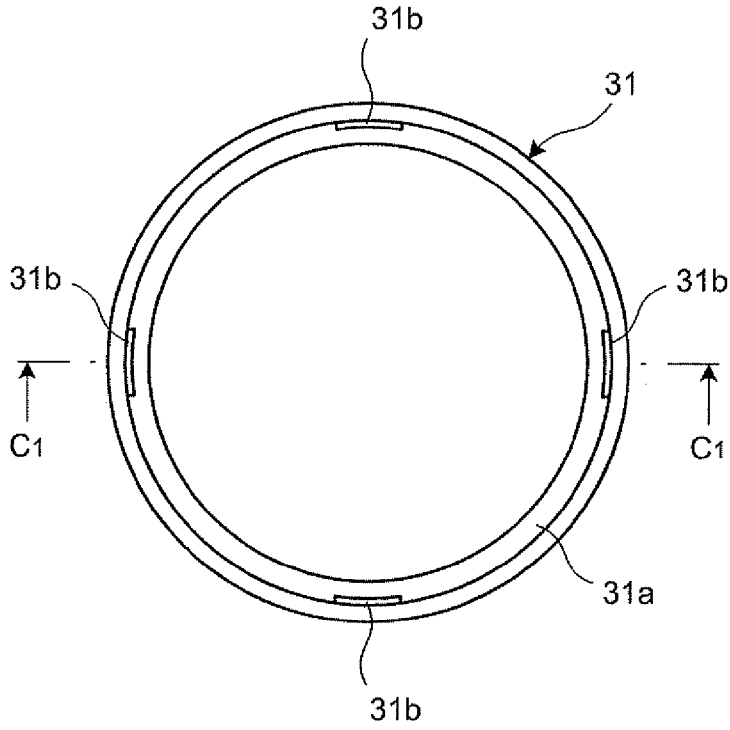
FIG. 4 is a plan view of an outer lid of the sample container of FIG. 1.
Figure 5:
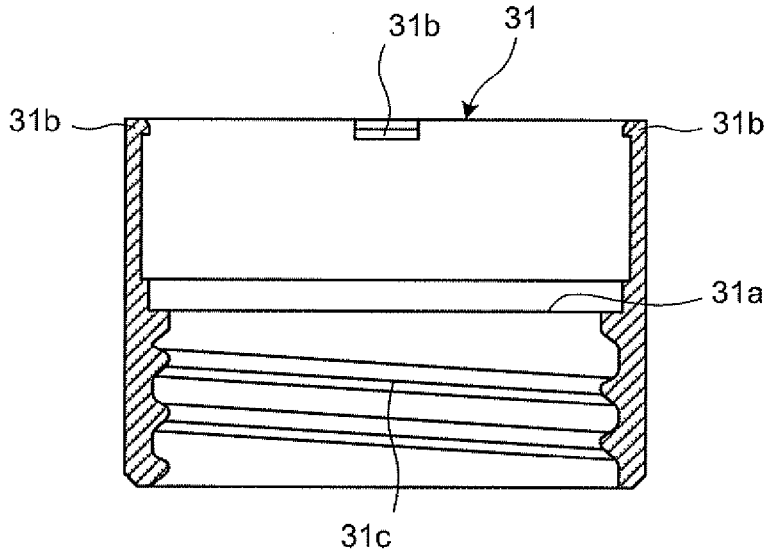
FIG. 5 is a sectional view of the outer lid along line C1-C1 of FIG. 4.

The outer lid 31 is a cylindrical member covering the male screw portion 2*b* of the container body 2, and has a step 31*a* on an inner circumference at a substantially vertically central position as shown in FIGS. 4 and 5. The outer lid 31 has four bosses 31*b* formed at equal intervals along a circumferential direction on an upper portion of the inner circumference. The outer lid 31 further includes a female screw portion 31*c* on the inner circumference below the step 31*a*. The female screw portion 31*c* is screwed onto the male screw portion 2*b*.

Figure 6:
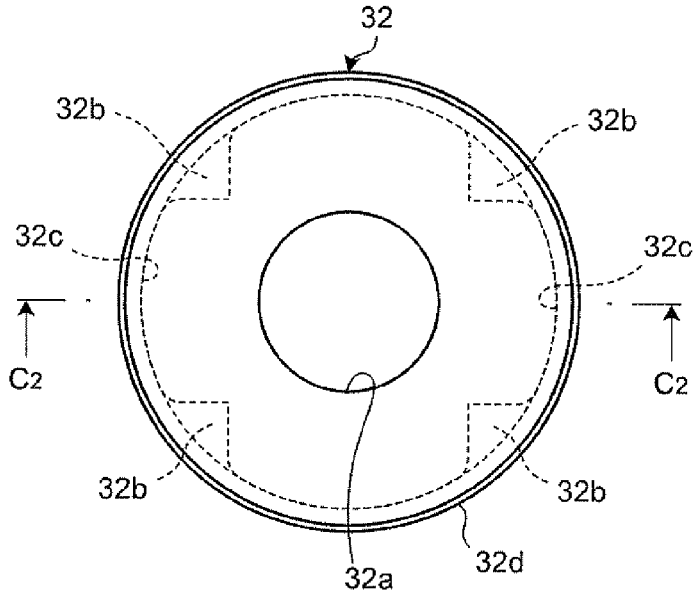
FIG. 6 is a plan view of an inner lid of the sample container shown in FIG. 1.
Figure 7:
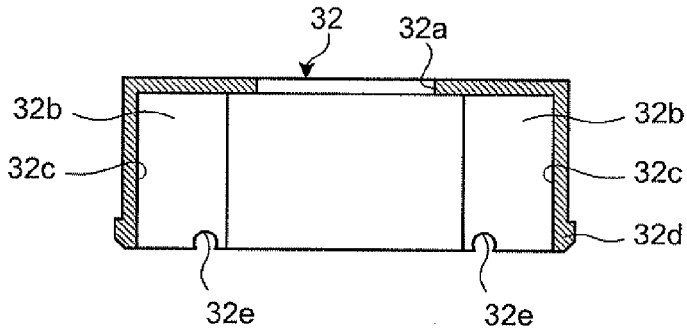
FIG. 7 is a sectional view of the inner lid along line C2-C2 of FIG. 6.

The inner lid 32 is fitted into the outer lid 31 in a vertically slidable manner. The inner lid 32 has an opening 32*a* in an upper central portion for dispensing a liquid sample as shown in FIGS. 6 and 7. In the inner lid 32, depressed portions 32*c* are formed by four ribs 32*b* arranged along a circumferential direction. The shutter 34 is arranged in the depressed portion 32*c*. The inner lid 32 has a flange 32*d* formed along the circumferential direction on a lower outer circumference. The flange 32*d* works as a retainer by engaging with four bosses 31*b* formed on the outer lid 31, as shown in FIG. 7. On a lower portion of each rib 32*b*, a groove-like engaging portion 32*e* is formed.

Figure 8:
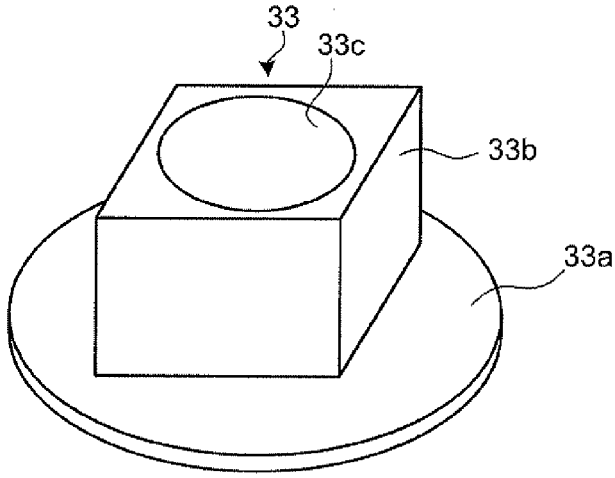
FIG. 8 is a perspective view of a translating unit used in the sample container.
Figure 9:
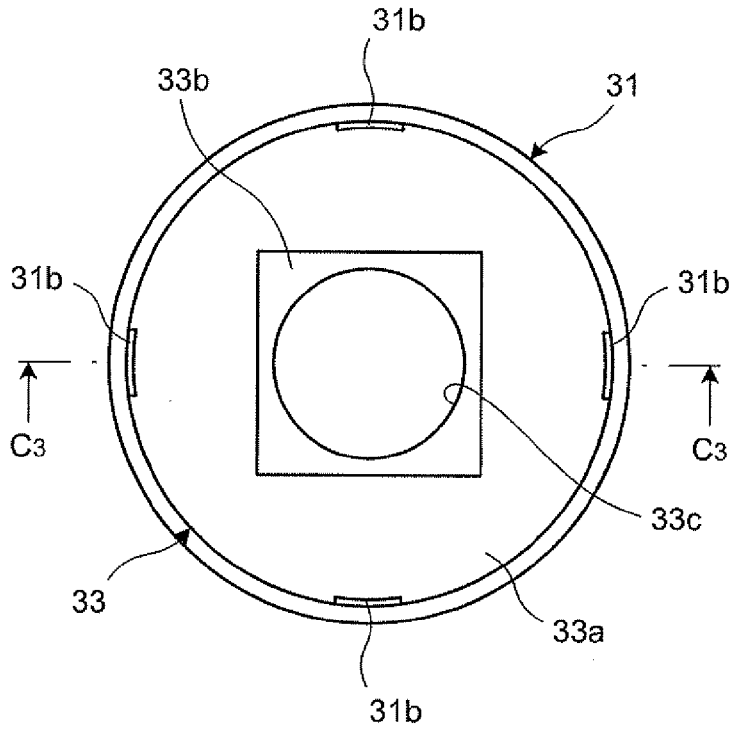
FIG. 9 is a plan view of the outer lid to which the translating unit is fitted.
Figure 10:
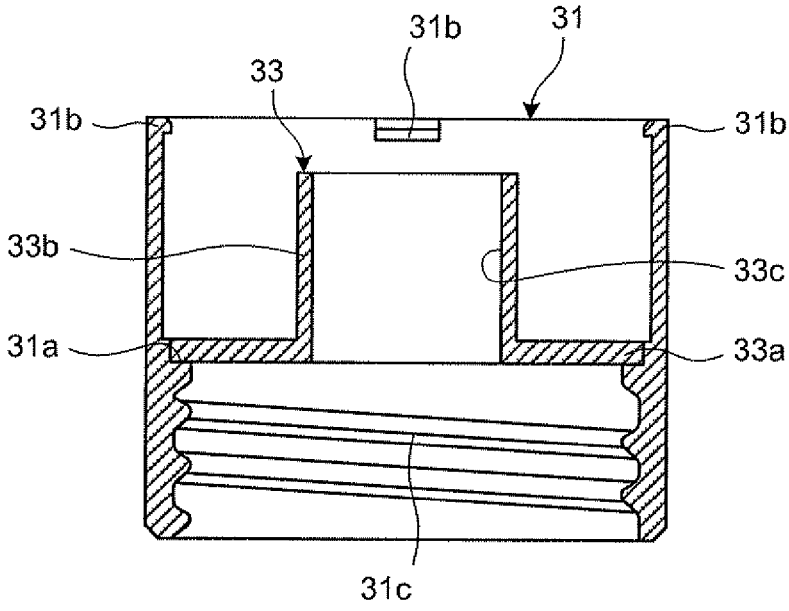
FIG. 10 is a sectional view of the outer lid along line C3-C3 of FIG. 9.

The translating unit 33 translates sliding movements of the inner lid 32 against the outer lid 31 to rotations of the shutters 34. As shown in FIG. 8, a square-pole-like support 33*b* is arranged at the center of a disk-like base plate 33*a* and projects upwards. A through hole 33*c* for dispensing the liquid sample is formed in the center of the support 33*b* (see FIGS. 2 and 3). The through hole 33*c* leads to an interior of the container body 2. The translating unit 33 is fitted and fixed to the outer lid 31 with an adhesive or the like as shown in FIGS. 9 and 10, with the base plate 33*a* abutted against the step 31*a*.

Figure 11:
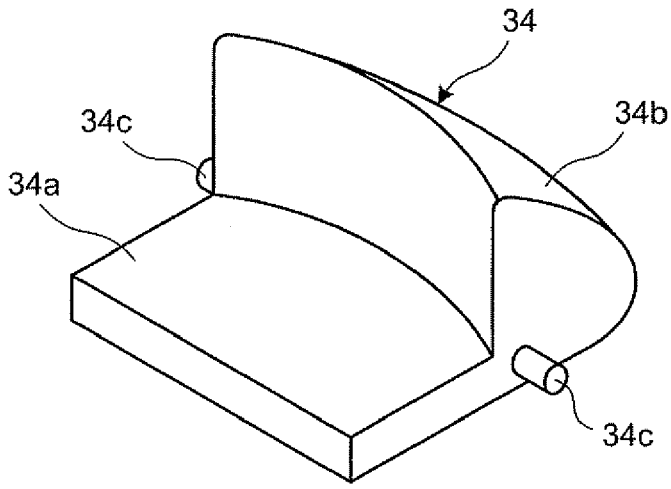
FIG. 11 is a perspective view of a shutter used in the sample container.
Figure 12:
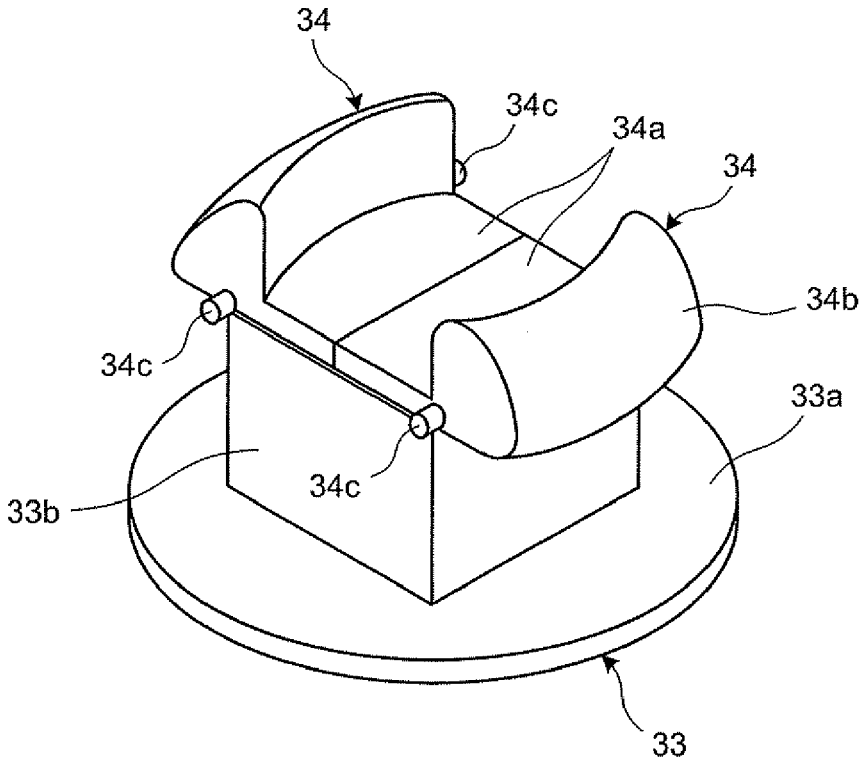
FIG. 12 is a perspective view showing an arrangement of the shutter shown in FIG. 11 and the translating unit.

In the shutter 34, as shown in FIG. 11, a protrusion 34*b* is formed at the end of a sealing plate 34*a* so as to project upward from the plate surface. A shaft 34*c* projects from each lateral side of the shutter 34 near the protrusion 34*b*. Two mutually-opposing sealing plates 34*a* of the shutters 34 are arranged on the support 33*b* so as to cover the through hole 33*c* as shown in FIG. 12. The shutter 34 is arranged in the depressed portion 32*c* with each shaft 34*c* of the shutter 34 fitted into the engaging portion 32*e* of the inner lid 32. The shutter 34 rotates around the shaft 34*c* to freely close and open the through hole 33*c*. The protrusion 34*b* has a curved surface so that the shutter 34 does not interfere with the wall surface of the depressed portion 32*c* of the inner lid 32 positioned radially outward when the shutter 34 rotates around the shaft 34*c*.

Figure 13:
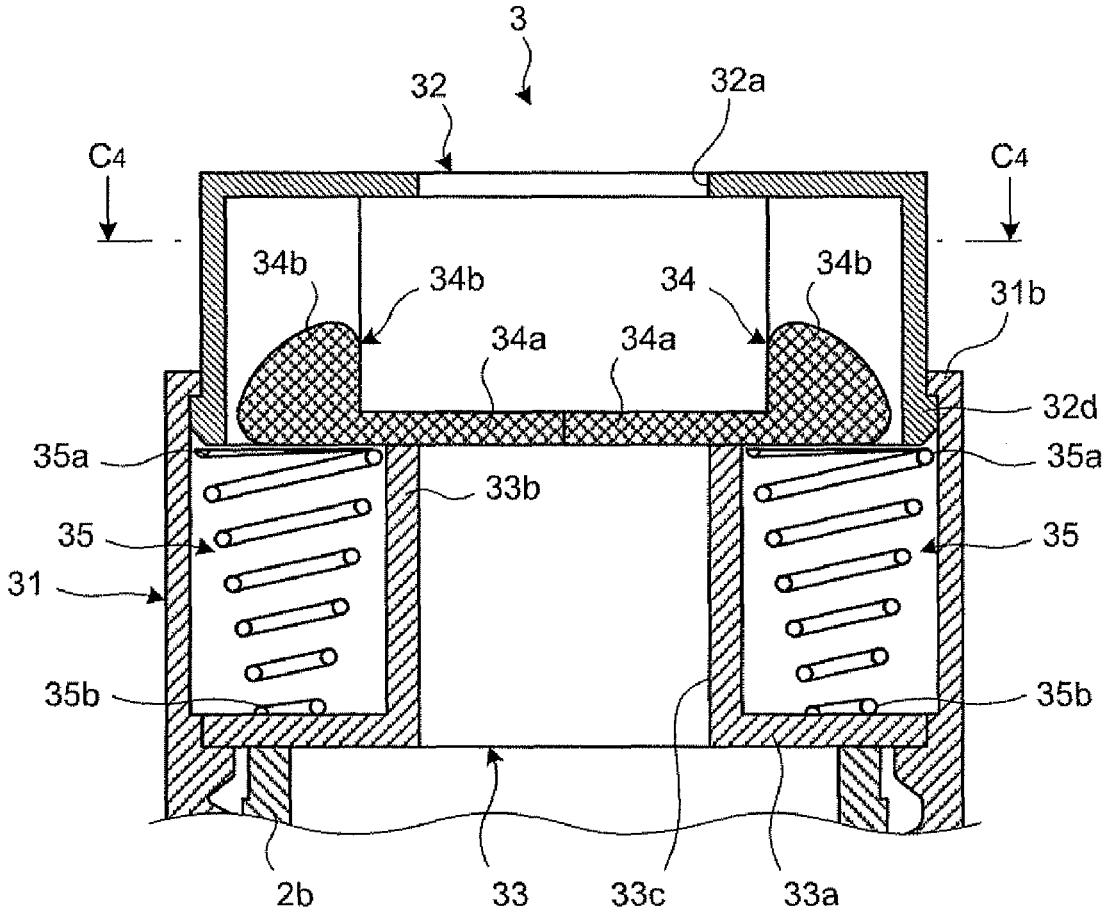
FIG. 13 is an enlarged sectional elevation view of a cap portion of the sample container shown in FIG. 2.

The pressing member 35 is an inverted-cone-like compression spring which has a large-diameter portion 35*a* and a small-diameter portion 35*b* and presses the shutter 34 in a direction to close the shutter 34. As shown in FIG. 13, the pressing member 35 is arranged between an upper surface of the base plate 33*a* of the translating unit 33 and a lower surface of the protrusion 34*b* of the shutter 34. The pressing member 35 is arranged between the translating unit 33 and the shutter 34 with the large-diameter portion 35*a* at the top and the small-diameter portion 35*b* at the bottom. With this arrangement, the large-diameter portion 35*a* of the pressing member 35 is always in contact with the lower surface of the protrusion 34*b*. Therefore, regardless of the rotating position of the shutter 34, the pressing member 35 can exert its spring force stably. Alternatively, the pressing member 35 can be a drum-like compression spring whose diameter is smaller in the middle than in the upper and the lower portions.

Figure 14:
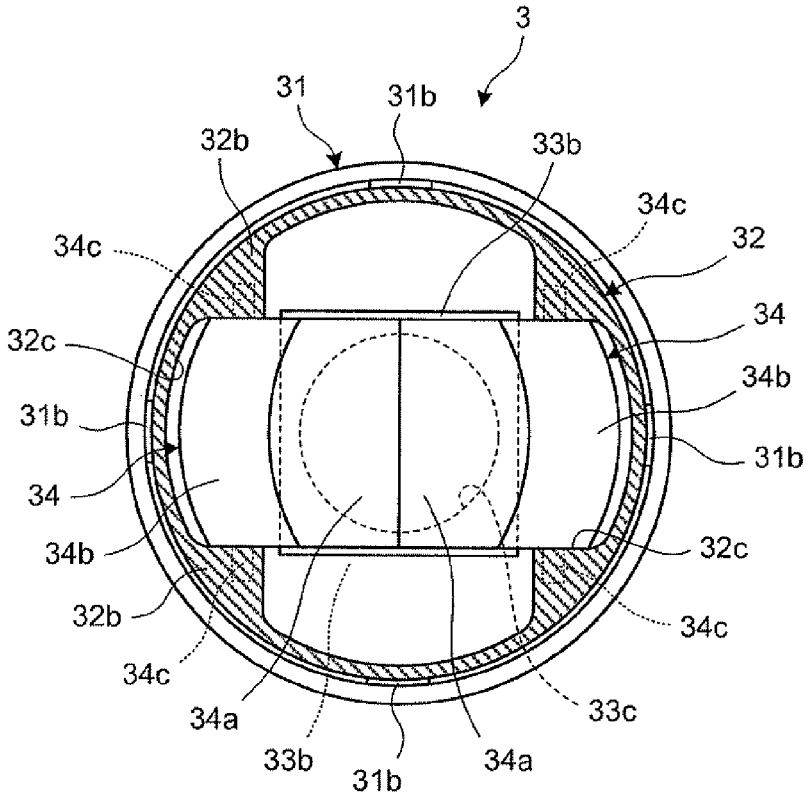
FIG. 14 is a sectional view along line C4-C4 of FIG. 13.

When the liquid sample is not dispensed from the sample container 1 configured as described above, spring force of the pressing member 35 works on the shutter 34 in a direction to close the shutter. Therefore, the through hole 33*c* of the translating unit 33 is closed by two shutters 34 as shown in FIGS. 2, 13, and 14, and the sample container 1 can suppress the evaporation of the contained liquid sample containing a reagent and a test body.

Figure 15:
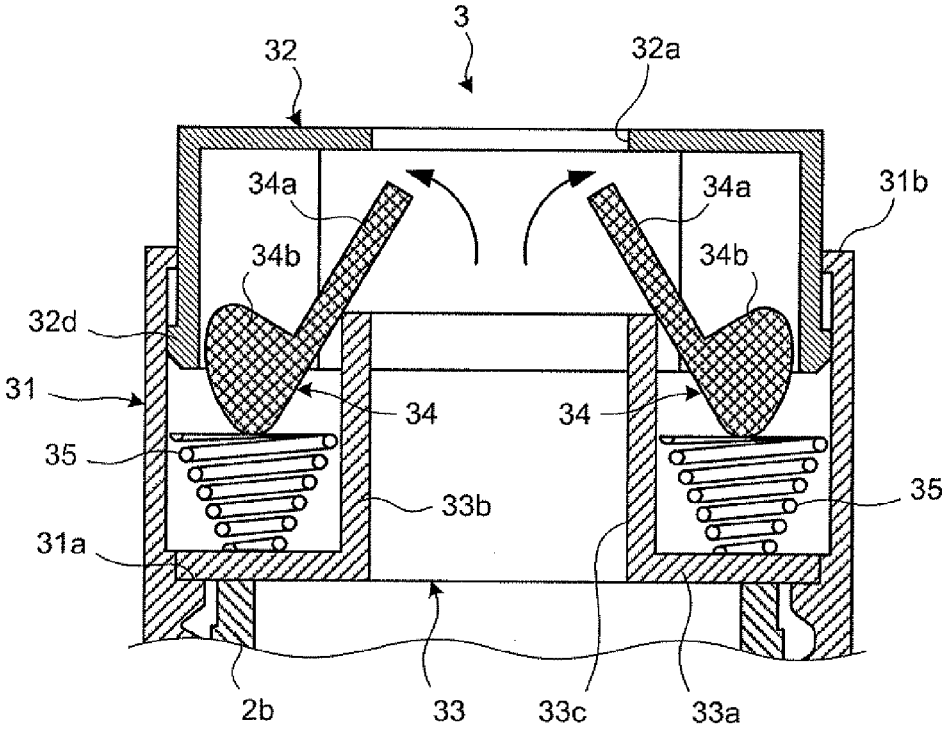
FIG. 15 is an enlarged sectional elevation view of the cap portion of the sample container with the inner lid pressed halfway down.

On the other hand, when the liquid sample is dispensed from the sample container 1, the inner lid 32 is pressed down. In the sample container 1, the shaft 34*c* is fitted into the engaging portion 32*e* of the inner lid 32 so that the two shutters 34 are arranged in the depressed portions 32*c*. As the inner lid 32 is pressed down, an upper edge of the support 33*b* of the translating unit 33 pushes the lower portion of each of the sealing plates 34*a* of the shutters 34 at a position slightly inward from the position of the shaft 34*c* as shown in FIG. 15. As a result, the downward sliding movements of the inner lid 32 against the outer lid 31 are translated into the rotation of the shutter 34 around the shaft 34*c* by the translating unit 33. Therefore, the shutter 34 rotates as shown by an arrow in FIG. 15 so that the sealing plate 34*a* gradually rises to open the through hole 33*c*, and the pressing member 35 is pressed and compressed by the protrusion 34*b*.

Figure 16:
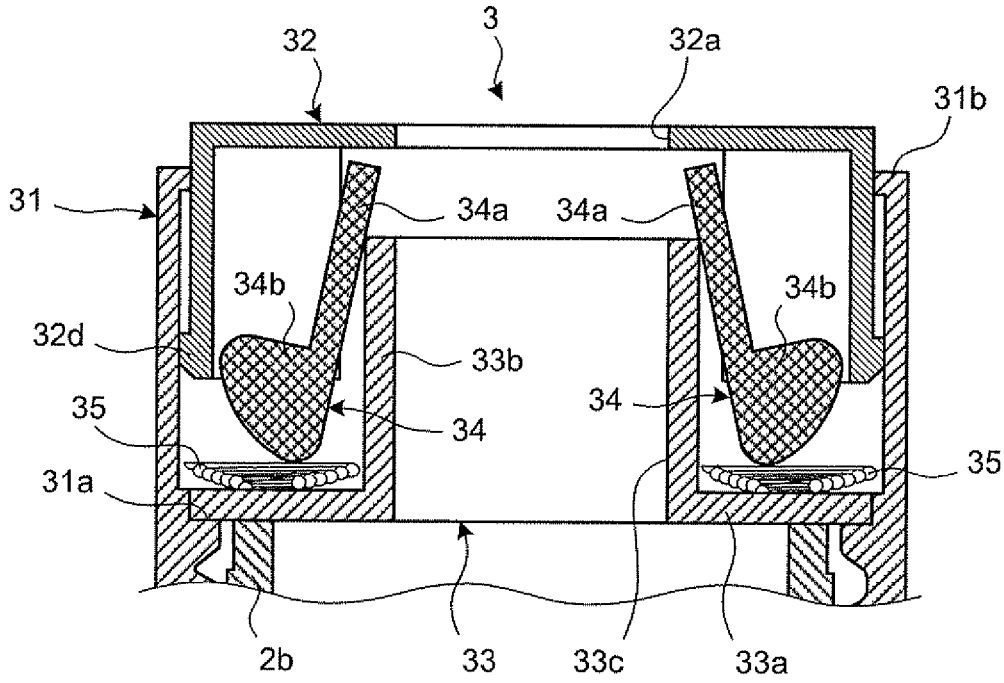
FIG. 16 is an enlarged sectional elevation view of the cap portion of the sample container with the inner lid pressed down to a lowermost position.
Figure 17:
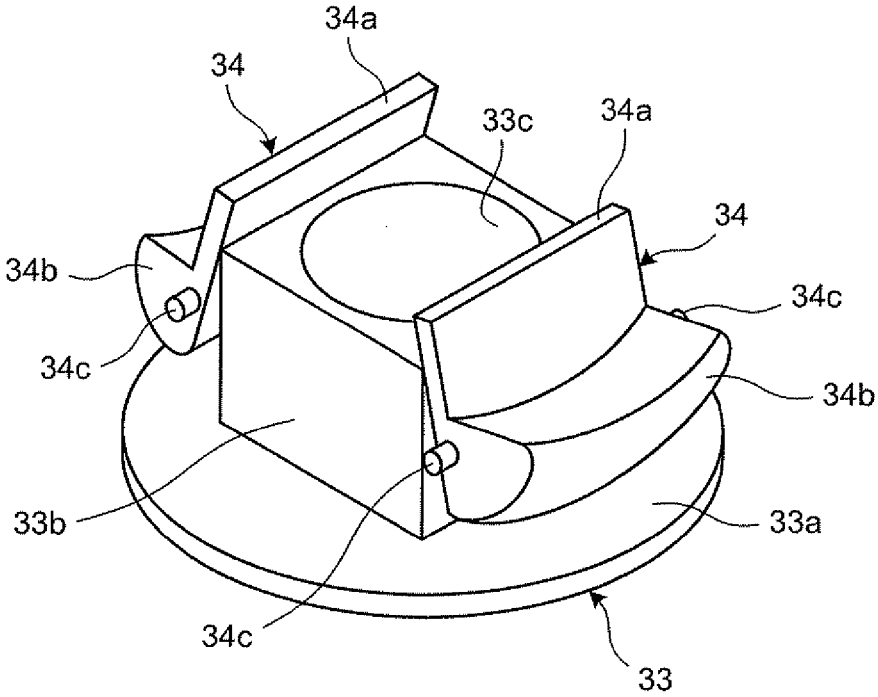
FIG. 17 is a perspective view showing an arrangement of the shutter and the translating unit in the state shown in FIG. 16.

When the inner lid 32 is pressed further downward, the sealing plate 34*a* of the sample container 1 rises up to a nearly upright position as shown in FIG. 16. The sealing plate 34*a* thus restricts the pressing-down of the inner lid 32, opens the through hole 33*c*, and the protrusion 34*b* compresses the pressing member 35 to a maximum extent. Positional relation between the translating unit 33 and two shutters 34 in this state is shown in FIG. 17. With the above-described operations, the interior of the container body 2 of the sample container 1 is communicated with the outside via the opening 32*a* of the inner lid 32 and the through hole 33*c*. While the sample container is in this state, a dispensing nozzle (not shown) is inserted into the opening 32*a* of the inner lid 32 from above. Then, the liquid sample such as the reagent and the test body contained in the sample container 1 can be dispensed.

After the dispensing of the liquid sample is finished, the inner lid 32 is released from the pressure. Then, in the sample container 1, the lower surface of the protrusion 34*b* is pushed up due to the restoring force of the pressing member 35. The shutter 34 rotates around the shaft 34*c* which is fitted in the engaging portion 32*e* in a reverse direction from the rotation in the above-described operation so as to return to the horizontal position. Thus, the inner lid 32 of the sample container 1 returns to the original position and two shutters 34 close the through hole 33*c* of the translating unit 33. Thus, simply when the inner lid 32 is released from the pressure, the pressing member 35 returns the inner lid 32 to the original position and the shutters 34 close the through hole 33*c* in the sample container 1, whereby the sample container 1 can open and close the shutters 34 with a simple structure.

Thus, in the sample container 1, the translating unit 33 translates the vertical sliding movements of the inner lid 32 against the outer lid 31 into the rotations of the two shutters 34 around the shafts 34*c*, and the cap 3 includes only five types of members, namely, the outer lid 31, the inner lid 32, the translating unit 33, the shutter 34, and the pressing member 35. Therefore, the sample container 1 has a simple structure and a smaller number of parts. Thus, in the sample container 1, the cap 3 can be assembled easily, and a simple, stable operation of the shutter can be realized. In addition, in the sample container 1, the shutter 34 rotates inside the cap 3, and does not move outside the cap 3, in particular, outside the container body 2 when viewed from above the sample container 1. Thus, a space required for the arrangement of the sample container 1 can be suppressed, and even when plural sample containers are placed next to another, for example, when used in an automatic analyzer, each sample container does not interfere with other sample containers 1.

In the above-described embodiment, the pressing member 35 is arranged between the translating unit 33 and the shutter 34. Alternatively, however, the pressing member 35 may be a coil spring arranged in a stretched state between the shutter 34 and a lower inner surface of the inner lid 32 as far as the pressing member 35 can exert a force on the shutter 34 in a direction to close the shutter 34.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A sample container comprising:

a cap that covers a container body holding a liquid sample containing a reagent and a test body, the cap including an outer lid that covers the container body, an inner lid that is slidably attached to the outer lid and has an opening for dispensing the liquid sample, a shutter that has a shaft engaging with the inner lid, a translating unit that is fitted to the outer lid and translates sliding movements of the inner lid against the outer lid to rotation of the shutter around the shaft, and a pressing member that presses the shutter in a direction to close the shutter, wherein the rotation of the shutter opens and closes a hole formed in the translating unit for dispensing the liquid sample.

2. The sample container according to claim 1, wherein the pressing member is a compression spring arranged between the shutter and the translating member.

* * * * *